US011833827B2

(12) United States Patent
Komamiya

(10) Patent No.: US 11,833,827 B2
(45) Date of Patent: Dec. 5, 2023

(54) PRINTING APPARATUS, METHOD OF CONTROLLING PRINTING APPARATUS, AND STORAGE MEDIUM

(71) Applicant: CANON KABUSHIKI KAISHA, Tokyo (JP)

(72) Inventor: Eiji Komamiya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 17/585,267

(22) Filed: Jan. 26, 2022

(65) Prior Publication Data

US 2022/0258478 A1 Aug. 18, 2022

(30) Foreign Application Priority Data

Feb. 12, 2021 (JP) ..... 2021-020474

(51) Int. Cl.
*B41J 2/17* (2006.01)
*B41J 2/175* (2006.01)

(52) U.S. Cl.
CPC ..... *B41J 2/1721* (2013.01); *B41J 2/17566* (2013.01); *B41J 2002/1728* (2013.01); *B41J 2002/17569* (2013.01)

(58) Field of Classification Search
CPC ..... B41J 2/1721; B41J 2/17566; B41J 2002/1728; B41J 2002/17569; B41J 2/17509
See application file for complete search history.

(56) References Cited

U.S. PATENT DOCUMENTS 6,357,854 B1 * 3/2002 Igval ..... B41J 2/16523 347/29

FOREIGN PATENT DOCUMENTS

JP 3576352 B2 * 10/2004
JP 2007-160868 6/2007

* cited by examiner

*Primary Examiner* — Sharon Polk
(74) *Attorney, Agent, or Firm* — Venable LLP

(57) ABSTRACT

The present disclosure provides a printing apparatus that is capable of obtaining accurately the amount of a waste liquid discharged from a printing unit. The printing apparatus includes a discharge unit that executes a discharge operation to discharge the liquid from the ejection port of the printing unit. The printing apparatus also includes a determination unit that determines filling states of the liquid in a printing apparatus main body and the printing unit and an obtaining unit that obtains, based on the filling states, a waste liquid amount discharged from the ejection port by the discharge operation.

15 Claims, 9 Drawing Sheets

PRINTING APPARATUS, METHOD OF CONTROLLING PRINTING APPARATUS, AND STORAGE MEDIUM

BACKGROUND OF THE INVENTION

Field of the Invention

The present disclosure relates to a printing apparatus that includes a printing unit performing printing by ejecting a liquid and, particularly, relates to a technique of obtaining an amount of a waste liquid discharged from the printing unit.

Description of the Related Art

In an ink jet type printing apparatus that performs printing by ejecting ink from a printing head, recovery processing for recovering the ejection performance of the printing head is executed by discharging from ejection ports of the printing head forcibly the ink and the like that are thickened in the ejection ports. Such recovery processing may include processing of sucking and discharging the ink forcibly from the ejection ports of the printing head by generating a negative pressure in a cap covering the ejection ports.

In general, waste ink discharged from the printing head by the suction discharge processing is stored in a waste ink storage unit provided in the printing apparatus. In a conventional printing apparatus, the amount of the waste ink discharged to the waste ink storage unit is estimated, and once the waste ink amount in the waste ink storage unit reaches a storage limit, control to stop the discharge of the waste ink is performed.

Japanese Patent Laid-Open No. 2007-160868 discloses a printing apparatus that performs control as described above. Specifically, in the printing apparatus disclosed in Japanese Patent Laid-Open No. 2007-160868, the waste ink amount stored in a waste ink storage container is counted by a waste ink counting unit, and based on whether the count value reaches a storage limit of the waste ink storage container, a recovery operation is inhibited, and a notification is made to a user.

SUMMARY OF THE INVENTION

However, in the technique disclosed in Japanese Patent Laid-Open No. 2007-160868, a value counted by the waste ink counting unit may be diverged from a count value corresponding to the waste ink amount actually discharged to the waste ink storage container. Specifically, the count value by the waste ink counting unit may be greater than the count value corresponding to the waste ink amount actually discharged to the waste ink storage container. In this case , there is a risk that the waste ink storage unit may be replaced before reaching the storage limit amount.

An object of the present disclosure is to provide a printing apparatus that is capable of obtaining accurately the amount of a waste liquid discharged from a printing unit, a method of controlling the printing apparatus, and a storage medium.

The present disclosure is a printing apparatus including: a printing unit that performs printing by ejecting a liquid from an ejection port of the printing unit; a discharge unit that executes a discharge operation to discharge the liquid from the ejection port; a determination unit that determines filling states of the liquid in a printing apparatus main body and the printing unit; and an obtaining unit that obtains, based on the filling states, a waste liquid amount discharged from the ejection port by the discharge operation.

According to the present disclosure, it is possible to obtain accurately the amount of a waste liquid discharged from a printing unit.

Further features of the present invention will become apparent from the following description of exemplary embodiments with reference to the attached drawings.

DESCRIPTION OF THE EMBODIMENTS

Figure 1:
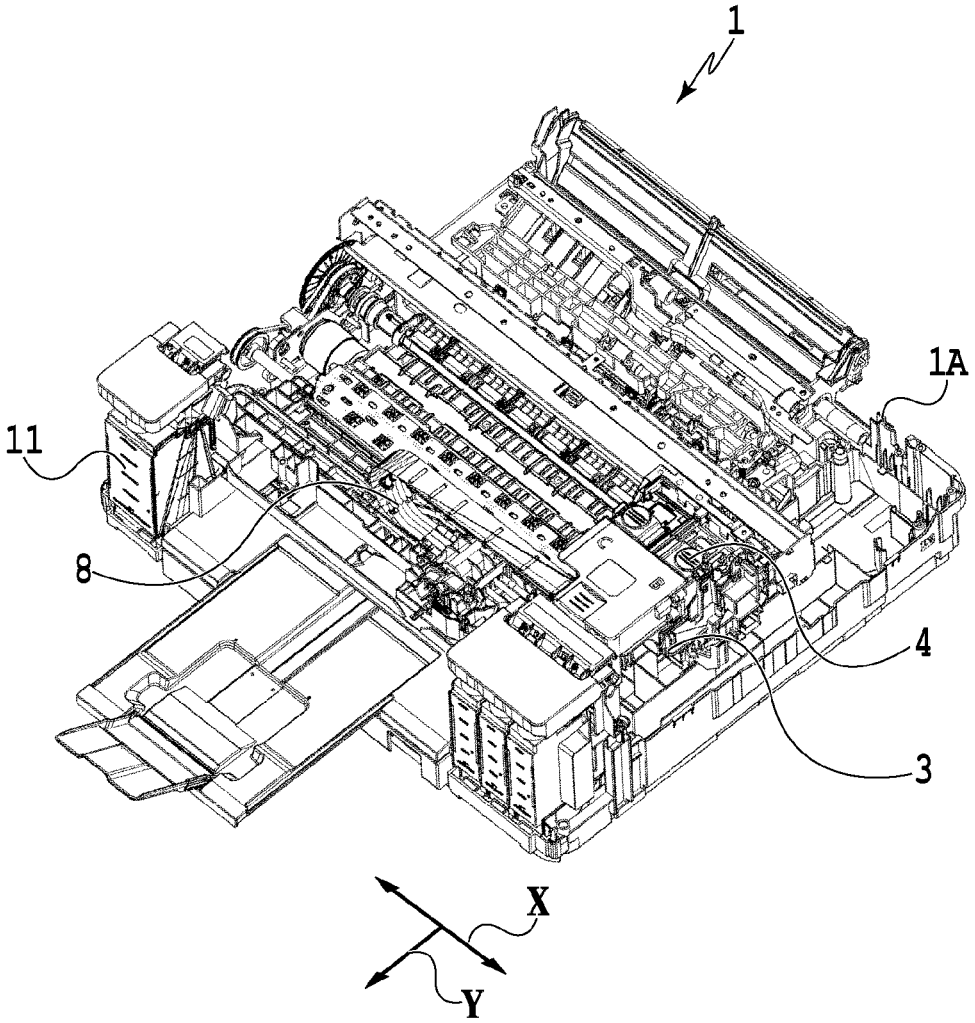
FIG. 1 is a perspective view of a printing apparatus in the present embodiment.

FIG. 1 is a perspective view illustrating a printing apparatus 1 in the present embodiment. The printing apparatus 1 in this embodiment is an ink jet type printing apparatus that performs printing by ejecting ink (a liquid) from a printing head (a printing unit). A carriage 3 is supported by a printing apparatus main body 1A so as to be reciprocate along a main scanning direction (X direction). A printing head 4 that ejects the ink is mounted on the carriage 3. The printing head 4 is coupled to an ink tank 11, which accumulates the ink, via a supply tube 8. The ink accumulated in the ink tank 11 is supplied to the printing head 4 through the supply tube 8 forming an ink supply channel.

Figure 2:
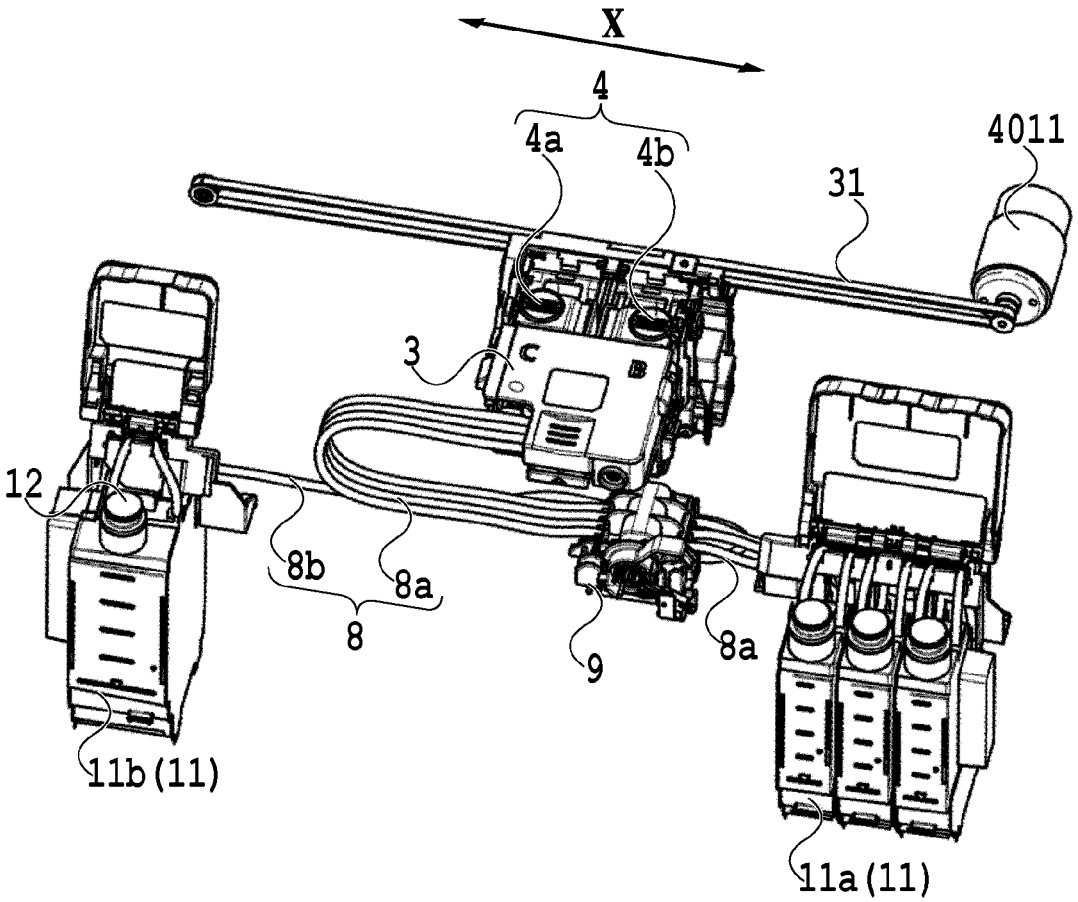
FIG. 2 is a perspective view illustrating an ink supply mechanism.

FIG. 2 is a perspective view illustrating an ink supply mechanism in a first embodiment. The ink tank 11 accumulating the ink includes ink tanks 11*a* for colors, which respectively accumulate multiple types of color ink (in this example, three colors of ink: cyan; magenta; and yellow) and an ink tank 11*b*, which accumulates black ink. The printing head 4 includes a printing head 4*a* for color ink to eject each color ink and a printing head 4*b* for black ink to eject the black ink. The ink tanks 11*a* for color ink are coupled to the printing head 4*a* via supply tubes 8*a*. The ink tank 11*b* for black ink is coupled to the printing head 4*b* via a supply tube 8*b*. A tube valve 9 is provided on the supply tubes 8*a* and 8*b*, and this tube valve 9 allows for switching of communication and shut-out between the ink tank 11 and the printing head 4. In FIG. 2, 4011 indicates a carriage motor that generates driving force for moving the carriage 3 along the main scanning direction. An endless belt 31 is moved by the driving force by the carriage motor 4011 along the main scanning direction (X direction) in a forward direction and a backward direction, and accordingly the carriage 3 is moved in an advance direction and a return direction.

Figure 3:
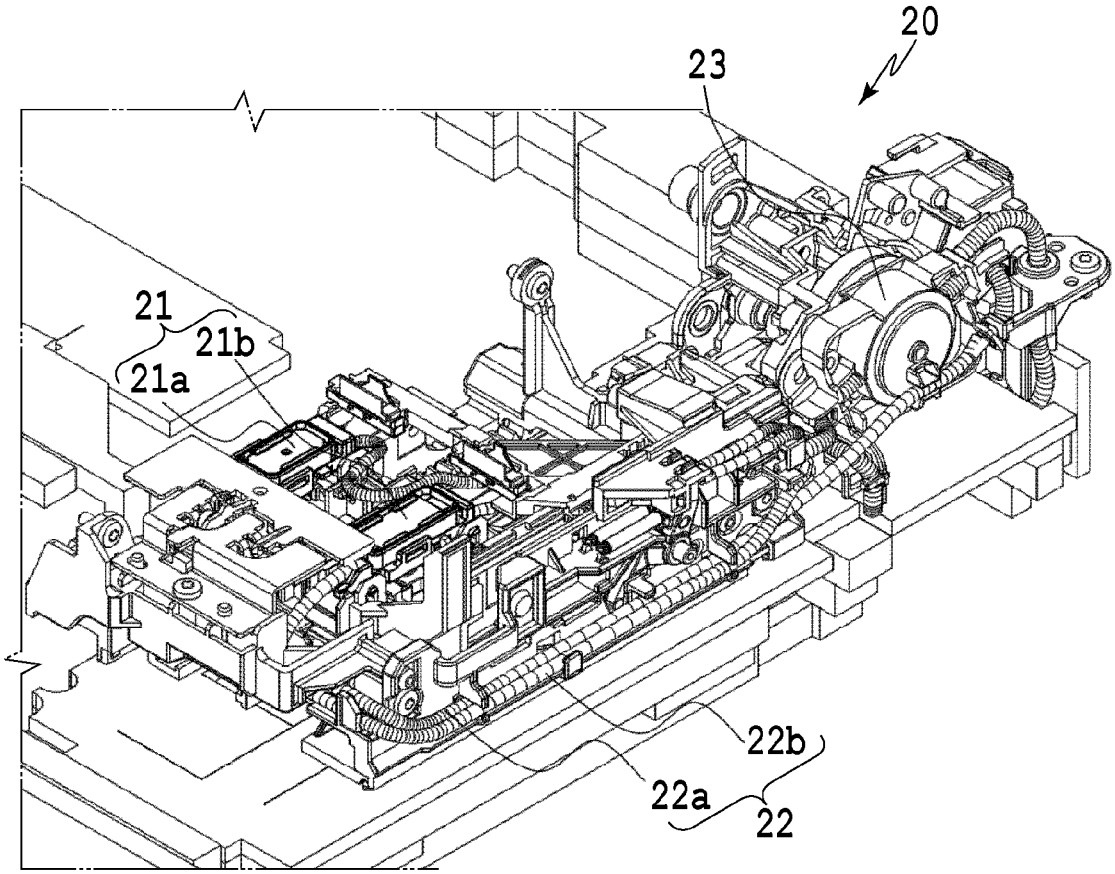
FIG. 3 is a perspective view illustrating a recovery mechanism.

FIG. 3 is a perspective view illustrating a recovery mechanism 20 as a discharge unit that sucks and discharges the ink forcibly from ejection ports 7 of the printing head 4. The recovery mechanism 20 in this embodiment is provided with a cap 21 to cover the ejection ports 7 of the printing head 4 and a suction pump 23 coupled to the cap 21 via a suction tube 22. As the cap 21, there are provided a cap 21*a* that covers ejection ports provided in the printing head 4*a* for color ink and a cap 21*b* that covers ejection ports provided in the printing head 4*b* for black ink. The caps 21*a* and 21*b* are coupled to the suction pump 23 via suction tubes 22*a* and 22*b*, respectively.

Figure 4:
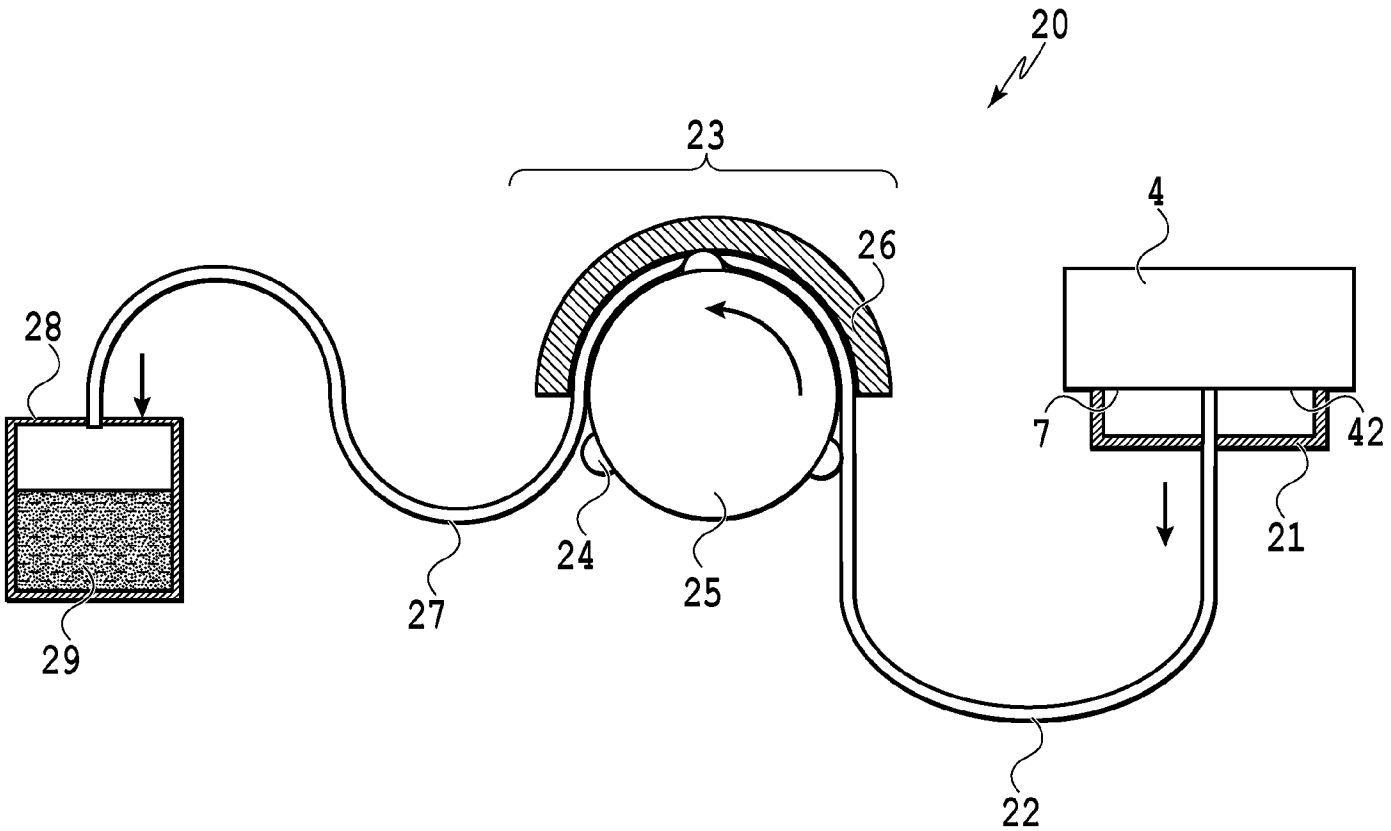
FIG. 4 is an explanatory view illustrating a configuration of the recovery mechanism in more detail.

FIG. 4 is an explanatory view illustrating a configuration of the recovery mechanism 20 in the first embodiment in more detail. The ejection ports 7 that eject the ink are arrayed on an ejection port surface 42 positioned at a bottom surface portion of the printing head 4. The cap 21 is raised and lowered by a not-illustrated raising and lowering mechanism, and in a case of being raised, the cap 21 is put in close contact with the ejection port surface 42 of the printing head 4 and covers the ejection ports 7, and in a case of being lowered, the cap 21 is away from the ejection port surface 42 and opens the ejection ports 7.

In the state where the cap 21 is put in close contact with the ejection port surface 42 of the printing head 4 (closed state), it is possible to suck the ink from the ejection ports 7 by driving the suction pump 23. In the suction pump 23, with a rotation shaft 25 rotated in a direction of an arrow, rollers 24 arranged in multiple portions (three portions in FIG. 4) on a periphery of the rotation shaft 25 are rotated and moved while sequentially pushing the suction tube 22 arranged between the rotation shaft 25 and a guide 26. Thus, air or the ink in the suction tube 22 are sent to a waste ink tube 27 at the downstream, and the inside of the suction tube 22 is depressurized. As a result, a negative pressure is generated in a sealed space that is formed between the cap 21 and the ejection port surface 42 of the printing head 4. This negative pressure allows the ink in the printing head 4 to be sucked and discharged forcibly from the ejection ports 7 to the cap 21. The suction amount and suction force by the suction pump 23 can be adjusted by controlling the predetermined number of rotation and rotation speed of the rotation shaft 25.

The ink discharged from the suction pump 23 is stored into a waste ink tank 28 by way of the waste ink tube 27. A waste ink absorber 29 is provided in the waste ink tank (a waste liquid storage unit) 28. The waste ink tank 28 in this embodiment is formed to be attachable to and detachable from a printing apparatus main body and is able to be replaced by a user.

Figure 5:
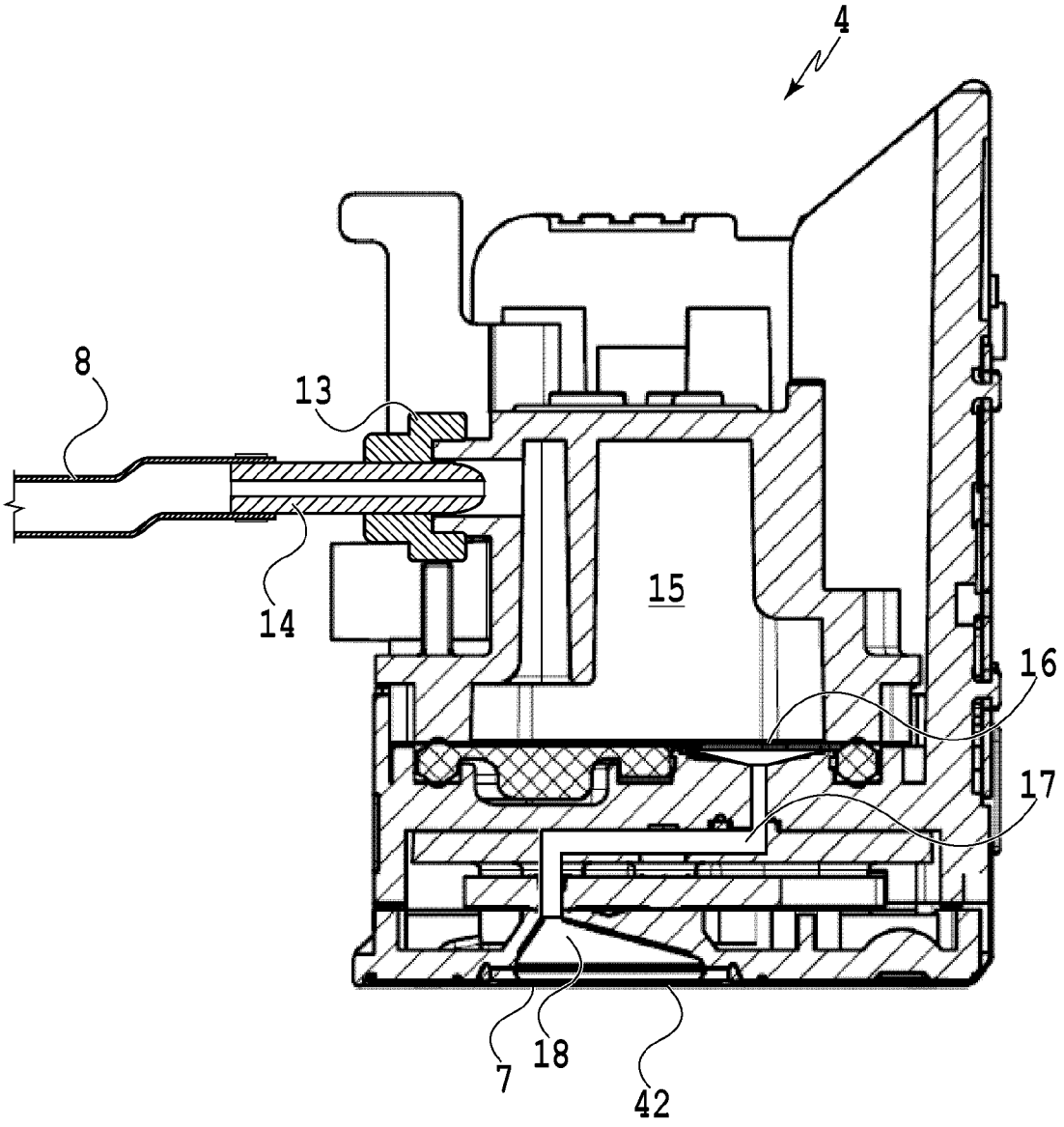
FIG. 5 is a vertical cross-sectional view illustrating an internal structure of a printing head mounted in the printing apparatus.

FIG. 5 is a vertical cross-sectional view illustrating an internal structure of the printing head 4 mounted in the printing apparatus 1 in this embodiment. A tip end of the supply tube 8, which is coupled to the ink tank 11, is coupled to an upper portion of the printing head 4. This coupling is made by press-fitting a needle 14 provided at the tip end of the supply tube 8 into a joint portion 13 formed of an elastic member provided in the printing head 4. A sub tank 15 that can hold a certain amount of ink is provided inside the printing head 4. A filter 16 for removing a foreign substance contained in the ink is provided at a bottom portion of the sub tank 15. An ink flow channel 17 is formed below the filter 16, and a liquid chamber 18 is formed below the ink flow channel 17. The ink that passes through the filter 16 and flows into the ink flow channel 17 is supplied to the liquid chamber 18. The multiple ejection ports 7 formed in the ejection port surface 42 communicate with a bottom portion of the liquid chamber 18, and the ejection ports 7 are filled with the ink supplied from the liquid chamber 18.

The printing head 4 in this embodiment employs the ink jet type in which the ink is ejected from the ejection ports 7 and includes electrothermal conversion elements that generate thermal energy as ejection energy generation elements that generate ejection energy to eject the ink. The electrothermal conversion elements are provided to the corresponding ejection ports 7. The electrothermal conversion elements generate thermal energy in accordance with a pulse signal, and film boiling is generated in the ink by the thermal energy such that a pressure change occurs in the ink; thus, the ink is ejected from the ejection ports 7 by the pressure change. With the ink ejected from the ejection ports 7 landing on a printing medium, an image is formed. In auxiliary ejection, which is performed as recovery processing described later, the ink is ejected from the ejection ports 7 to the cap 21 covering the ejection ports 7.

Figure 6:
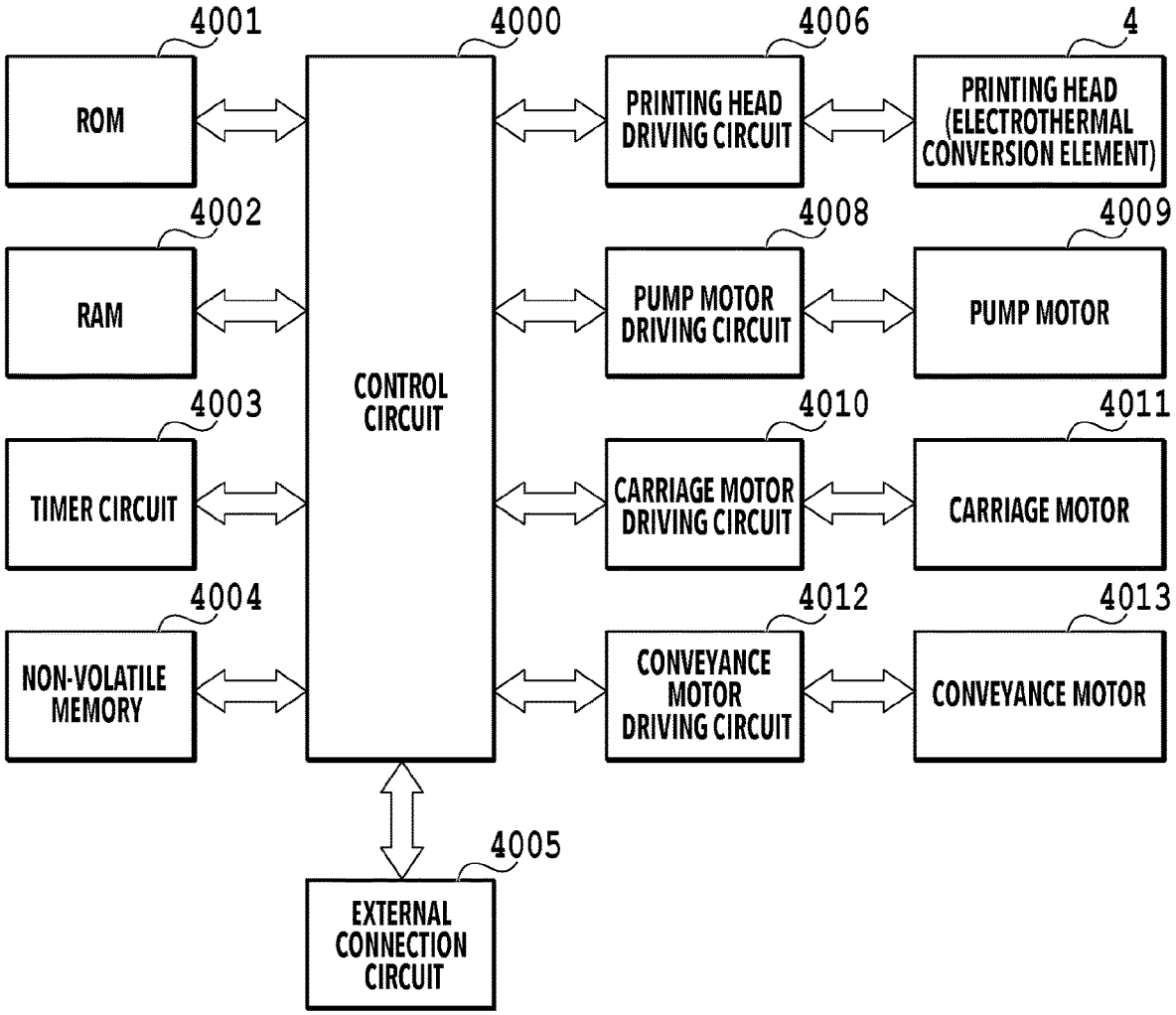
FIG. 6 is a block diagram illustrating a configuration of a control system in the present embodiment.

FIG. 6 is a block diagram illustrating a configuration of a control system in this embodiment. A control circuit 4000 executes a control program stored in a ROM 4001 or a control program deployed in a RAM 4002. The control circuit 4000 functions as a control unit that controls operations of units in the printing apparatus and also functions as a determination unit that performs determination processing and an obtaining unit for a waste ink amount, described later. A sequence executed in this embodiment is a part of a sequence executed by the control program deployed in the RAM 4002. The ROM 4001 stores the control program executed by the control circuit 4000 and various setting values. The RAM 4002 includes a region in which the program is deployed in a case of executing the control program stored in the ROM 4001, a region in which printing data and a control command are stored, a region in which a control variable in each control is stored, and the like.

A timer circuit 4003 is a circuit capable of obtaining current clock time and measuring elapsed time. A non-volatile memory 4004 is a storage unit that can hold data, such as a parameter, stored by the control operation, even in a state where the power of the printing apparatus 1 is shut off. The non-volatile memory 4004 is used to write and read clock time as a start point in a case of calculating the elapsed time during the control in this embodiment.

An external connection circuit 4005 is a circuit that functions as an interface to make wired or wireless communication between an external host apparatus and the printing apparatus 1, and by way of this external connection circuit 4005, a signal is transmitted and received between the host apparatus and the printing apparatus 1. For example, printing data created by the host apparatus is inputted to the control circuit 4000 by way of this external connection circuit 4005. It is also possible to input current clock time to the control circuit 4000 of the printing apparatus 1 by way of the external connection circuit 4005.

In a case of executing the printing operation, the control circuit 4000 deploys the printing data received from the host apparatus in the RAM 4002. Additionally, based on the printing data deployed in the RAM 4002, the control circuit 4000 controls the driving of the electrothermal conversion elements of the printing head 4 by way of a printing head driving circuit 4006, and at the same time, controls the carriage motor 4011 by way of a carriage motor driving circuit 4010. It is possible to perform the printing on the printing medium by moving the carriage 3 in the main scanning direction by the carriage motor 4011 and ejecting the ink from a desired printing head 4 to a desired position on the printing medium. The printing operation executed by moving the printing head 4 in the main scanning direction is called print scanning. Every time the print scanning is performed once, the control circuit 4000 drives a conveyance motor 4013 by way of a conveyance motor driving circuit 4012 to convey the printing medium by a predetermined amount. With the print scanning and the convey operation (also referred to as sub scanning) of the printing medium executed repeatedly, an image is printed on the entirety of the printing medium. Thus, the printing apparatus in this embodiment is a serial type printing apparatus that performs printing while moving the printing head.

The control circuit 4000 controls a pump motor 4009 as a driving source of the suction pump 23 by way of a pump motor driving circuit 4008. The pump motor 4009 rotates the rotation shaft 25 of the suction pump 23 and thereby generates a negative pressure in the cap 21 put in close contact with the ejection port surface 42. The auxiliary ejection in which the ink is ejected to the cap 21 is performed by the control circuit 4000 driving the electric heat generation elements of the printing head 4 by way of the printing head driving circuit 4006. In this case, as with the printing operation, a pattern to drive the printing head 4 is based on either the data deployed in the RAM 4002, the data stored in the ROM 4001, or the data generated in the control circuit 4000.

The printing apparatus 1 executes the recovery operation for purpose of removing air bubbles mixed in the printing head 4, discharging the thickened or solidified ink, filling ink filling regions from the ink tank 11 to the printing head 4 with the ink, and the like. This recovery operation is required in the following cases, for example. Specifically, the recovery operation is required in the cases where:

(i) after an abnormality ends (after the power of the apparatus main body is turned off unexpectedly), the cap 21 is left while being away from the ejection port surface 42 of the printing head 4;

(ii) the ink tank 11 is replaced;

(iii) a certain period of time is elapsed from the execution of the last recovery operation;

(iv) the amount of the ink (the number of ejection) required for the printing operation after the execution of the last recovery operation is equal to or greater than a certain value, and the like.

In this embodiment, in a case as described above, the control circuit 4000 sets a recovery flag and stores the recovery flag in the non-volatile memory 4004 illustrated in FIG. 6. Based on the recovery flag, the control circuit 4000 executes the recovery operation in a predetermined timing. The amount of waste ink discharged from the printing head 4 by the recovery operation is set for every recovery operation, and once each recovery operation is executed, the waste ink amount discharged by the recovery operation is cumulatively added to the waste ink storage amount stored in the waste ink tank 28. In this embodiment, once a recovery operation to be executed is selected, a total value of the waste ink collection amount cumulatively added from the start of using the waste ink tank 28 and the waste ink storage amount of the selected recovery operation is obtained before the recovery operation is executed. If it is determined that the obtained total value exceeds the storage limit amount of the waste ink tank 28, the selected recovery operation is canceled, and a message indicating that it is impossible to execute the recovery processing is notified to the user. In this example, this notification to the user is performed by displaying the message on a not-illustrated UI (user interface) panel; however, the notification may be made by sound.

Figure 7:
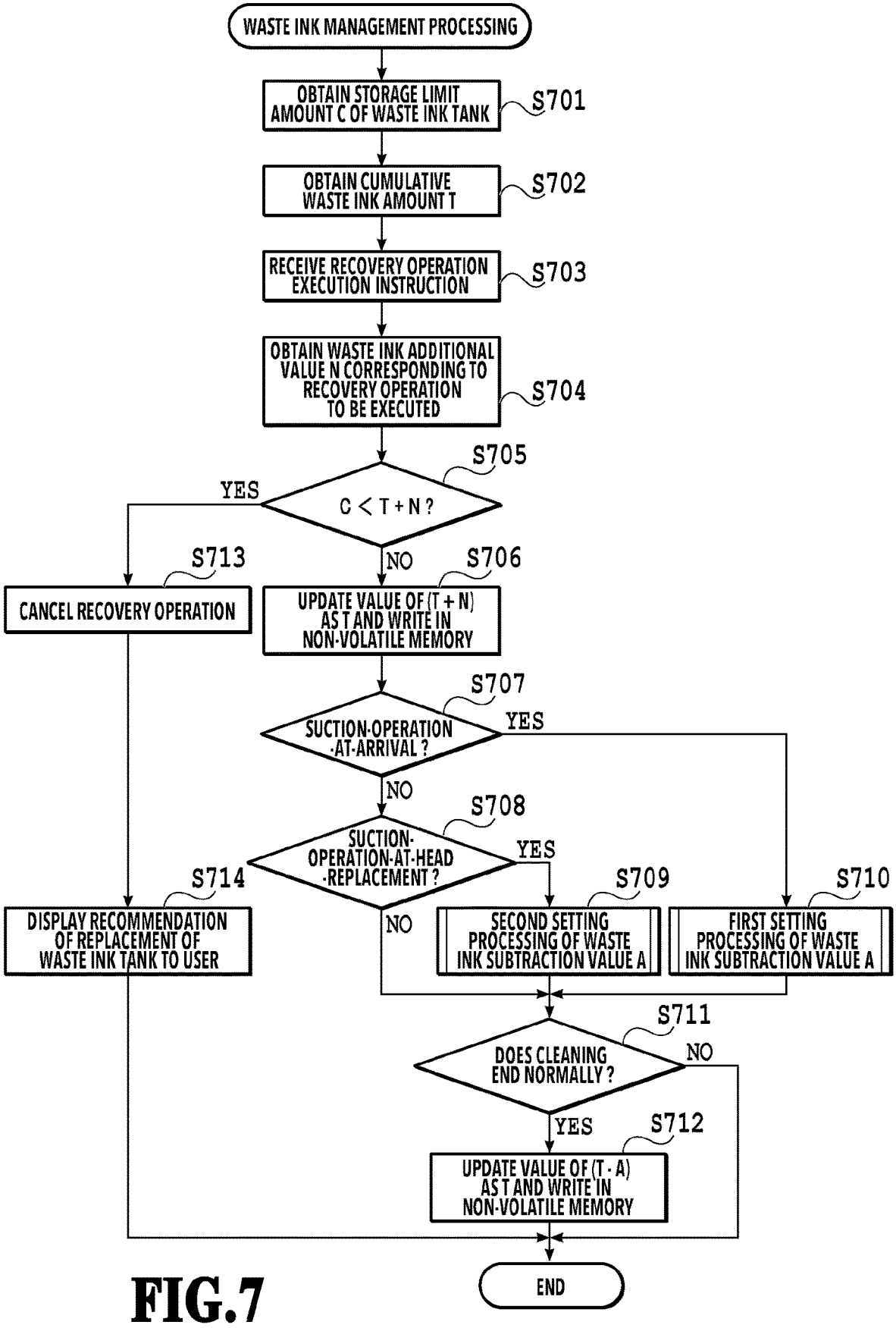
FIG. 7 is a flowchart illustrating an overall processing procedure of waste ink management control in the present embodiment.

FIG. 7 is a flowchart illustrating an overall processing procedure of waste ink management control executed by the control circuit 4000.

Hereinafter, the processing procedure executed in this embodiment is described with reference to the flowchart in FIG. 7. In the flowcharts in FIGS. 7 to 9, S assigned to each step number means Step.

First, in S701, the control circuit 4000 obtains information on a storage limit amount C of the waste ink tank 28 stored in the ROM 4001. The storage limit amount C of the waste ink tank 28 indicates the maximum amount of the waste ink amount that the waste ink tank can store.

Next, in S702, the control circuit 4000 obtains a cumulative waste ink amount T stored in the not-illustrated non-volatile memory 4004 attached to the waste ink tank 28. The cumulative waste ink amount T means a cumulative amount of the waste ink that is stored until that time in the waste ink tank 28 having no usage history.

Next, in S703, the control circuit 4000 receives an execution instruction of the recovery operation. The execution instruction of the recovery operation is an instruction issued based on the recovery operation flag stored in the non-volatile memory 4004. This recovery operation flag is stored into the non-volatile memory 4004 in a case where the user inputs a user recovery operation from a printer driver or the UI panel or in the cases (i) to (iv) described above, for example. Based on this recovery operation flag, a recovery instruction to execute the recovery operation is issued in a timing of, such as, turning on the power of the apparatus main body, before the printing starts, after the printing starts, and designating the recovery operation by the user.

Subsequently, in S704, the control circuit 4000 obtains a waste ink amount N discharged to the waste ink tank 28 by the suction recovery operation to be executed. This waste ink amount N indicates a value added to the waste ink amount already stored in the waste ink tank 28 and is referred to as a waste ink additional value N in the following descriptions. The waste ink additional value N is a value obtained by converting the waste ink amount ejected from the ejection ports of the printing head 4 into the number of ink droplets (a count value). The count value is managed by the unit of mg. The waste ink additional value N includes the waste ink discharged to the cap 21 in the auxiliary ejection.

In this embodiment, since it is expected that multiple types of recovery operations are executed in accordance with purpose, the waste ink additional value N (the count value) is set individually for each recovery operation. Table 1 shows a relationship between each type of the recovery operations that can be executed in this embodiment and the waste ink additional value N of the corresponding recovery operation.

The suction recovery operation may include normal suction in which a small amount of ink (the count value is 100) is sucked, powerful suction in which a greater amount of ink than that of the normal suction (the count value is 500) is sucked, system suction for replacing ink in a printing head and a tube with new ink, and the like. In the system suction, a suction operation to suck a great amount of ink, the count value is about 30000, is executed. In this embodiment, a suction-operation-at-arrival as a first suction operation executed in a case where the printing apparatus 1 is arrived, and a suction-operation-at-head-replacement executed in a case where the printing head 4 is replaced are executed. In the suction-operation-at-arrival, a suction operation to suck ink of the count value of 50000 as the ink waste ink additional value N is executed. In the suction-operation-at-head-replacement, a suction operation to suck ink of the count value of 40000 as the waste ink additional value N is executed.

TABLE 1

Relationship Between Each Type of Recovery Operations and Waste Ink Additional Value N
waste ink additional value N

| recovery operation type | count value |
|---|---|
| normal suction operation | 100 |
| powerful suction operation | 500 |
| system suction operation | 30000 |
| suction-operation-at-arrival | 50000 |
| suction-operation-at-head-replacement | 40000 |

Next, in S705, the control circuit 4000 determines whether a total value (T+N) of the cumulative waste ink amount T obtained in S702 and the waste ink additional value N obtained in S704 exceeds the storage limit amount C of the waste ink tank obtained in S701. If it is determined that the total value (T+N) exceeds the storage limit amount C, the control circuit 4000 cancels the recovery operation in S713 and displays recommendation of replacement of the waste ink tank 28 in S714. In S705, if it is determined that the total value (T+N) does not exceed the storage limit amount C of the waste ink tank 28, the control circuit 4000 proceeds the processing to S706.

In S706, the control circuit 4000 updates the total value (T+N) of the cumulative waste ink amount T and the waste ink additional value N calculated and obtained in S705 as a new cumulative waste ink amount T and stores the new cumulative waste ink amount T in the non-volatile memory 4004.

In S707, the control circuit 4000 determines whether the recovery operation to be executed is the suction-operation-at-arrival. If the recovery operation to be executed is the suction-operation-at-arrival, the control circuit 4000 proceeds the processing to S710 and performs first setting processing of the waste ink subtraction value. If the recovery operation to be executed is other than the suction-operation-at-arrival, the control circuit 4000 proceeds the processing to S708 and determines whether the recovery operation to be executed is the suction-operation-at-head-replacement. In this process, if it is determined that the recovery operation to be executed is the suction-operation-at-head-replacement, the control circuit 4000 proceeds the processing to S709 and performs second setting processing of the waste ink subtraction value.

A waste ink subtraction value A set in S710 and S709 is a value that is set in accordance with the usage state of the printing apparatus 1 and is a value that should be subtracted from the cumulative waste ink amount set in S706 described above. The waste ink additional value N of the cumulative waste ink amount (T+N) set in S706 is a waste ink amount discharged from the printing head 4 in a case of executing the suction operation in the filling state where all the ink filling regions in the printing apparatus 1 are filled with the ink. However, at the arrival of the printing apparatus 1 or at the replacement of the printing head 4, there may be a region not filled with the ink. If the suction recovery operation is executed in such a situation, first, air is sucked and discharged from the printing head 4, and thereafter the ink is discharged. For this reason, in a case where there is an unfilled region with ink, the waste ink amount discharged from the printing head 4 is smaller than that in a case where there is no unfilled region even if the same suction recovery operation is executed. This shortage amount corresponds to the waste ink subtraction value A, and in each of S710 and S709, the processing (the first setting processing and the second setting processing) for setting the waste ink subtraction value A is executed. The first setting processing executed in S710 and the second setting processing executed in S709 are described in detail later with reference to the flowcharts in FIGS. 8 and 9.

After the setting processing in S709 and S710, the control circuit 4000 determines whether the selected recovery operation ends normally (S711). Only in a case where the recovery operation ends normally, the control circuit 4000 assumes that the ink filling regions of the printing apparatus 1 are filled with the ink and proceeds the processing to S712. If it is determined that the recovery operation does not end normally, the control circuit 4000 ends the waste ink management processing.

In S712, the control circuit 4000 subtracts the waste ink subtraction value A calculated in S710 or S709 from the cumulative waste ink amount T obtained in S706, updates the calculated value as a new cumulative waste ink amount T, and stores the updated value T into the non-volatile memory 4004. The above-described processing is an overall processing procedure of the waste ink management processing in this embodiment.

Next, the first setting processing of the waste ink subtraction value A that is executed in S710 in FIG. 7 is described in detail with reference to the flowchart in FIG. 8.

As described above, at the arrival of the printing apparatus 1, the ink filling regions in the printing apparatus 1 are not filled with the ink. Specifically, the printing head 4 and the supply tube 8 are not filled with the ink yet. In Table 2, the storage limit amount C of the waste ink in the waste ink tank 28 used in this embodiment, a capacity (a head capacity) Dh of the ink filling regions in the printing head 4, and a capacity (a tube capacity) Dc of the ink filling regions of the supply tube 8 are shown with count values. The count values are managed by the unit of mg. Those count values are fixed values determined for each type of device regardless of the usage state of the printing apparatus 1.

The tube capacity Dc of the supply tube 8 indicated herein is a total value of tube capacities of the supply tubes 8*a* and 8*b* for supplying the printing head 4 with the color inks and the black ink. The head capacity Dh of the printing head 4 is a total value of ink amounts filled in the sub tank 15, the liquid chamber 18, and ink flow channels that are provided for each of the color inks and the black ink.

TABLE 2

Fixed Count Value (mg) Used in the Present Example

| | count value |
|---|---|
| storage limit amount C of waste ink tank | 300000 |
| tube capacity Dc | 800 |
| head capacity Dh | 1000 |

Figure 8:
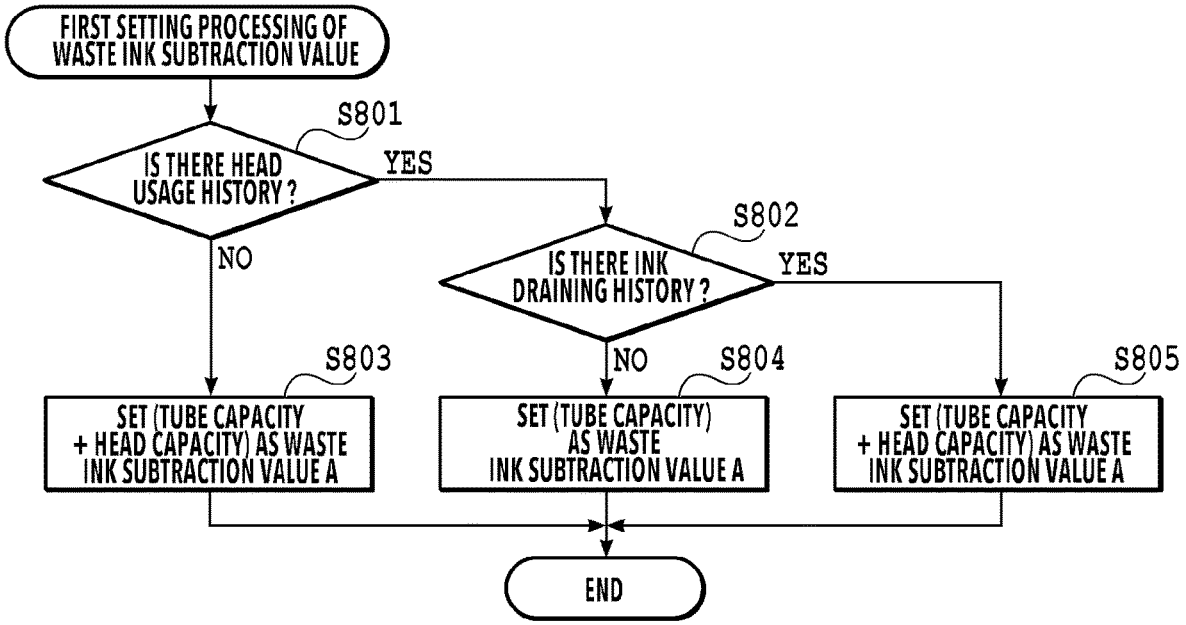
FIG. 8 is a flowchart illustrating first obtainment processing of a waste ink subtraction amount.

In FIG. 8, in 5801, the control circuit 4000 determines whether there is a usage history (a head usage history) of the mounted printing head 4. If there is no head usage history, the supply tube 8 and the printing head 4 are not filled with the ink. Accordingly, in S803, the control circuit 4000 sets a total value (Dc+Dh) of the tube capacity Dc and the head capacity Dh as the waste ink subtraction value A and ends the first setting processing. In the example shown in Table 2, the count value of the tube capacity DC is 800, and the head capacity Dh is 1000; accordingly, the count value of the subtraction value A is 1800.

If it is determined that there is a head usage history in S801, in S802, the control circuit 4000 further determines whether there is a history of ink draining (liquid draining). In this case, the ink draining indicates processing of discharging the ink from the printing head 4 filled with the ink. If it is determined that there is a history of the ink draining, the ink in the printing head 4 has been discharged; accordingly, in S805, the control circuit 4000 sets the total value of the tube capacity Dc and the head capacity Dh as the waste ink subtraction value A and ends the first setting processing. In this case, the count value of the subtraction value A is 1800. This subtraction value A is subtracted from the cumulative waste ink amount T obtained in S706 described above, and the new waste ink amount T obtained by this subtraction is a first waste ink amount (a first waste liquid amount) in the present disclosure.

On the other hand, if it is determined that there is no history of the ink draining in S802, the inside of the printing head 4 is filled with the ink; accordingly, in the setting of the waste ink subtraction value A, the control circuit 4000 does not use the head capacity Dh (S804). Specifically, in S804, the control circuit 4000 sets only the tube capacity Dc as the waste ink subtraction value A and ends the first setting processing. In this case, the count value of the subtraction value A is 800. This subtraction value A is subtracted from the cumulative waste ink amount T obtained in 5706 described above, and the new waste ink amount T obtained by this subtraction is a second waste ink amount (a second waste liquid amount) in the present disclosure. This second waste ink amount is a waste ink amount (a waste liquid amount) greater than the first waste ink amount described above.

The reason of determining whether there is a head usage history in S801 is because there is expected a case where the suction-operation-at-arrival is executed while a printing head that is used in another printing apparatus is mounted in the printing apparatus 1 in this embodiment. Even in such a case, the waste ink subtraction value A is subtracted from 50000, which is the waste ink additional value N at the arrival suction, in accordance with the usage state of the printing apparatus 1.

As described above, according to the waste ink management processing of this embodiment, in a case of executing the suction-operation-at-arrival, the waste ink amount subtracted in accordance with the usage state of the printing apparatus 1 is used to obtain the cumulative waste ink amount of the waste ink tank. This makes it possible to detect accurately the waste ink amount stored in the waste ink tank, and the accuracy of the determination on whether the amount of the waste ink stored in the waste ink tank 28 reaches the storage limit amount is also improved.

Next, the second setting processing of the waste ink subtraction value A executed in S709 in FIG. 7 is described in detail with reference to the flowchart in FIG. 9.

At the replacement of the printing head 4, since the above-described suction-operation-at-arrival has been executed, the inside of the supply tube 8 is filled with the ink. However, there is a possibility that the ink filling regions in the replaced printing head 4 may not be filled with the ink. Specifically, there is a possibility that the sub tank 15, the ink flow channel 17, and the liquid chamber 18 in the printing head 4 may not be filled with the ink. The ink capacity (the head capacity) in the printing head 4 is a total value of the ink amounts filled into flow channels and the like including the sub tank 15, the liquid chamber 18, and the ink flow channel 17. This total value is the head capacity Dh shown in Table 2.

Figure 9:
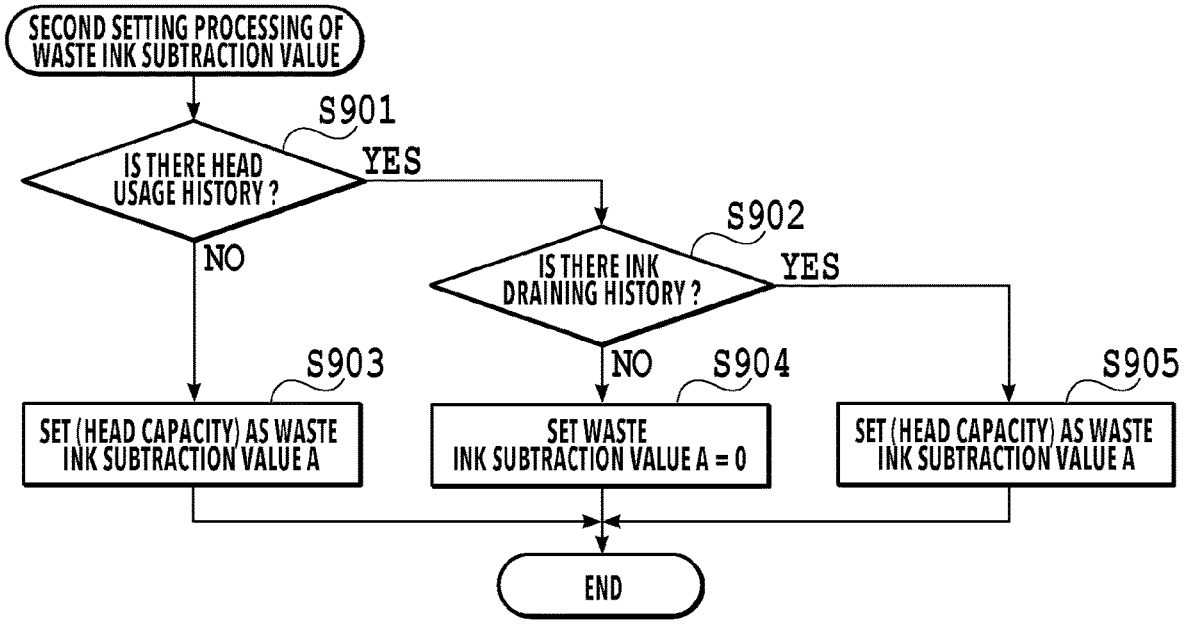
FIG. 9 is a flowchart illustrating second obtainment processing of a waste ink subtraction amount.

In FIG. 9, in S901, the control circuit 4000 determines whether there is a usage history (a head usage history) of the mounted printing head 4. If there is no head usage history, the inside of the printing head 4 is not filled with the ink. Accordingly, in S903, the control circuit 4000 sets the head capacity Dh as the waste ink subtraction value A and ends the second setting processing. In the example shown in Table 2, the head capacity Dh is 1000; accordingly, the count value of the subtraction value A is 1000. This subtraction value A is subtracted from the cumulative waste ink amount T obtained in S706 described above, and the new waste ink amount T obtained by this subtraction is a third waste ink amount (a third waste liquid amount) in the present disclosure.

If it is determined that there is a head usage history in S901, in S902, the control circuit 4000 further determines whether there is a history of the ink draining described above. If it is determined that there is a history of the ink draining, the ink in the printing head 4 has been discharged; accordingly, in S905, the control circuit 4000 sets the head capacity Dh as the waste ink subtraction value A and ends the second setting processing. In this case, the count value of the subtraction value A is 1000.

On the other hand, if it is determined that there is no history of the ink draining in S902, the inside of the printing head 4 is filled with the ink; accordingly, in the setting of the waste ink subtraction value A, the control circuit 4000 does not use the head capacity Dh as the waste ink subtraction value A (S904). Accordingly, in S904, the control circuit 4000 sets the waste ink subtraction value A to "0" and ends the second setting processing. Since this subtraction value A is "0", the cumulative waste ink amount T obtained in S706 described above is a fourth waste ink amount (a fourth waste liquid amount) in the present disclosure. This fourth waste ink amount is the maximum amount of the waste ink amount that can be discharged by the executed suction discharge operation and is a waste ink amount greater than the third waste ink amount described above.

The reason of determining whether there is a head usage history in S901 is because there is expected a case where the suction-operation-at-head-replacement is executed after a printing head 4 having a usage history is mounted again. Even in this case, the waste ink subtraction value A is subtracted from 50000, which is the waste ink additional value N at the arrival suction, in accordance with the usage state of the printing apparatus 1.

The above processing is the second setting processing of the waste ink subtraction value that is executed in the suction-operation-at-head-replacement. With this second setting processing executed, in a case of executing the suction-operation-at-head-replacement, the waste ink amount subtracted in accordance with the usage state of the printing head 4 is used to obtain the cumulative waste ink amount of the waste ink tank. This makes it possible to obtain accurately the waste ink amount stored in the waste ink tank, and the accuracy of the determination processing on whether the amount of the waste ink stored in the waste ink tank 28 reaches the storage limit amount is also improved. Consequently, needless replacement of a waste ink tank 28 that still can store the waste ink is reduced, and it is possible to use the waste ink tank 28 effectively.

(Other Embodiments)

In the above embodiment, an example where the obtainment processing of the waste ink amount in accordance with the usage state of the printing apparatus is executed for both the suction-operation-at-arrival and suction-operation-at-head-replacement; however, the present disclosure is not limited thereto. In the present disclosure, it is also possible to execute the above-described waste ink obtainment processing for only either of the suction-operation-at-arrival and the suction-operation-at-head-replacement. Even in this case, it is possible to obtain accurately the waste ink amount better than a conventional apparatus, and it is possible to improve the management accuracy of the waste ink amount stored in the waste ink tank.

In the above embodiment, descriptions are given while exemplifying the method of subtracting the waste ink amount in accordance with the usage state of the printing apparatus; however, the present disclosure is not limited thereto. For example, all the waste ink amounts in accordance with the usage state of the units in the printing apparatus may be stored in advance, and the corresponding waste ink amount may be selected in accordance with the usage state so as to be used for the obtainment processing of the waste ink amount.

In the above embodiment, the printing apparatus in which the waste ink tank is mounted detachably is described; however, similar effects as that of the above embodiment can be obtained also with a printing apparatus in which the waste ink tank is mounted fixedly.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-020474 filed Feb. 12, 2021, which is hereby incorporated by reference wherein in its entirety.

What is claimed is:

1. A printing apparatus, comprising:

a printing head coupled to a tank which accumulates liquid via a tube and which is configured to eject the liquid supplied through the tube from an ejection port to perform a printing operation;

a discharge unit that executes a discharge operation to discharge the liquid from the ejection port;

a determination unit that determines a filling state of the liquid in the tube and a filling state of the liquid in the printing head; and an obtaining unit that obtains, based on the filling states of the liquid in the tube and the liquid in the printing head, a waste liquid amount discharged from the ejection port by the discharge operation.

2. The printing apparatus according to claim 1, wherein the determination unit determines a capacity of an unfilled region with liquid in the tube and the printing head, and the obtaining unit obtains the waste liquid amount based on the capacity of the unfilled region.

3. The printing apparatus according to claim 2, wherein the determination unit determines the filling states based on whether a main body of the printing apparatus is in a state of arrival, and the obtaining unit obtains the waste liquid amount based on a result determined by the determination unit.

4. The printing apparatus according to claim 1, wherein the determination unit determines the filling states based on whether a main body of the printing apparatus is in a state of arrival, and the obtaining unit obtains the waste liquid amount based on a result determined by the determination unit.

5. The printing apparatus according to claim 4, wherein in a case where the main body and is in the state of arrival, the determination unit determines whether the printing head has a usage history, and in a case where the printing head has a usage history, the determination unit further determines whether the printing head has a liquid draining history, and in a case where the printing head has no usage history but has a liquid draining history, the obtaining unit obtains a first waste liquid amount, and in a case where the printing head has no liquid draining history, the obtaining unit obtains a second waste liquid amount greater than the first waste liquid amount.

6. The printing apparatus according to claim 5, wherein the obtaining unit obtains the first waste liquid amount by subtracting a capacity inside the printing head and a capacity inside the tube from the maximum waste liquid amount that the discharge unit is able to discharge from the ejection port by the discharge operation, and the obtaining unit obtains the second waste liquid amount by subtracting the capacity inside the tube from the maximum waste liquid amount.

7. The printing apparatus according to claim 1, wherein the determination unit determines whether the printing head is in a state of replacement, and the obtaining unit obtains the waste liquid amount based on a result determined by the determination unit.

8. The printing apparatus according to claim 7, wherein in a case where the printing head is in the state of replacement, the determination unit determines whether the printing head has a usage history, and in a case where the printing head has a usage history, the determination unit further determines whether the printing head has a liquid draining history, and in a case where the printing head has no usage history but has a liquid draining history, the obtaining unit obtains a third waste liquid amount, and in a case where the printing head has no liquid draining history, the obtaining unit obtains a fourth waste liquid amount greater than the third waste liquid amount.

9. The printing apparatus according to claim 8, wherein the obtaining unit obtains the third waste liquid amount by subtracting a capacity inside the printing head from the maximum waste liquid amount that the discharge unit is able to discharge from the ejection port by the discharge operation, and the obtaining unit obtains the maximum waste liquid amount as the fourth waste liquid amount.

10. The printing apparatus according to claim 1, wherein the obtaining unit obtains the waste liquid amount only in a case where the discharge operation by the discharge unit ends normally.

11. The printing apparatus according to claim 1, wherein the discharge unit discharges the liquid by sucking the liquid forcibly from the ejection port of the printing head.

12. The printing apparatus according to claim 1, wherein a waste liquid storage unit, which stores a waste liquid discharged from the ejection port by the discharge unit, is mounted in a main body of the printing apparatus.

13. The printing apparatus according to claim 12, wherein the waste liquid storage unit is provided to be attachable to and detachable from the main body.

14. A method of controlling a printing apparatus, comprising the steps of:

performing printing by ejecting a liquid from an ejection port of a printing head;

executing a discharge operation to discharge the liquid from the ejection port;

determining a filling state of the liquid in a tube which connects a tank accumulating the liquid and the printing head, and determining a filling state of the liquid in the printing head; and obtaining, based on the filling states of the liquid in the tube and the liquid in the printing head, a waste liquid amount discharged from the ejection port by the discharge operation.

15. A non-transitory computer readable storage medium storing a program for causing a computer to perform a method of controlling a printing apparatus, the method comprising the steps of:

performing processing to perform printing by ejecting a liquid from an ejection port of a printing head;

executing processing to execute a discharge operation to discharge the liquid from the ejection port;

determining a filling state of the liquid in a tube which connects a tank accumulating the liquid and the printing head, and determining a filling state of the liquid in the printing head; and obtaining, based on the filling states of the liquid in the tube and the liquid in the printing head, a waste liquid amount discharged from the ejection port by the discharge operation.

* * * * *